United States Patent [19]

Wagner

[11] Patent Number: 5,074,041

[45] Date of Patent: Dec. 24, 1991

[54] NAIL CLIPPING RETAINER

[76] Inventor: Todd E. Wagner, P.O. Box 224, Beavertown, Pa. 17813

[21] Appl. No.: 615,809

[22] Filed: Nov. 16, 1990

[51] Int. Cl.[5] ..... A45D 29/02

[52] U.S. Cl. ..... 30/28; 30/125; 132/75.5

[58] Field of Search ..... 30/28, 125; 132/75.5

[56] References Cited

U.S. PATENT DOCUMENTS

| | | | |
|---|---|---|---|
| 2,970,376 | 2/1961 | Kuo | 30/28 |
| 3,352,010 | 11/1967 | Keller | 30/28 X |
| 4,196,514 | 4/1980 | Merriman | 30/28 |

*Primary Examiner*—Hien H. Phan
*Assistant Examiner*—Raymond D. Woods

[57] ABSTRACT

A nail clipping retainer which prevents the scattering of fingernail and toenails from the cutting area of conventional nail clippers. The device retains nail fragments only as each fragment is being cut. The device mounts on the post between the upper and lower cutting members and fills the void between the cutting members when the members are fully depressed during a cutting process. Alternate methods of attachment and simplicity of manufacture allow for easy installation in new and previously produced nail clippers of various shapes and sizes. An optional clipping container may be used to store clipping after being retained by the retaining member described above. The clipping container detachably fastens to the post at the exterior side of the lower cutting member with a thin linear member equal in shape to the lower cutting member. A tube-like chamber which detachably mounts over the pivoting thin linear member is removed from a non-use position and is repositioned to receive nail clippings as the clippings leave the confines of the retaining member.

5 Claims, 2 Drawing Sheets

NAIL CLIPPING RETAINER

SUMMARY OF THE INVENTION

This invention is concerned with improvements to conventional fingernail and toenail clippers which prevent the scattering of nail fragments from the cutting area of the nail clippers.

Previous nail clipping guards or retainers enclose the open sides of the nail clippers in various ways to collect or contain nail fragments. This approach usually has one or many undesirable features which make them impractical or costly to manufacture profitably. The most prevalent being that nail clipping guards or retainers of this design must be made to exacting tolerances to fit a particular size and style of nail clipper, thus, making manufacturing of this type of guard or retainer very complex and impractical when one considers the magnitude of sizes and shapes of nail clippers in use and being manufactured presently. Another undesirable feature of the side enclosing guard or retainer is that most fingernails and toe nails extend past the enclosing walls of the guard or retainer making the enclosure method ineffective when large fragments are longer than the distance between the enclosing walls. Other disadvantages have been well documented in the prior art and are too numerous to list.

Conventional nail clippers, to which this invention relates, are the type where an upper and lower cutting edge, formed on the ends of spring members which are welded together in an opposing fashion at the end opposite the cutting edges, sever fingernails or toenails as each converge when compressed together as a result of the actuation of a cam lever mounted against the upper spring member. When cutting a nail, the nail fragment projects from the cutting edges and travels toward the pin which connects the cam lever to the lower spring member and ricochet from the pin and leaves the clippers in a unpredictable and undesirable fashion.

It is the primary object of this invention to provide a nail clipping retainer which is easily adapted to fit all types of conventional nail clippers while being simple and inexpensive to manufacture and install.

It is another object of this invention to provide a nail clipping retainer which prevents the scattering of fingernail or toenail fragments.

Another object of this invention is to provide a retainer which acts as a nail insertion depth gauge.

Another object of this invention is to provide a retainer which does not impede the user when cutting a nail which extends beyond the sides of the nail clippers.

Another object of this invention is to provide a retainer which does not require removal from the nail clippers when the user wants to dispose of an individual clipping fragment.

Another object of this invention is to provide a retainer which does not interfere with a fingernail filing attachment.

An optional object of this invention is to provide a nail fragment keeper to be used in conjunction with the retainer described hereinwith.

The objects of this invention are accomplished by attaching to fingernail and toenail clippers a device which fills the void between the upper and lower spring members during a cutting process in such a way as to retain the nail fragment within the nail clippers in the area between the post and the cutting edges. An optional nail fragment keeper can be used to receive and store nail fragments as the fragments leave the confines of the retaining device.

Those above mentioned and other objects and advantages of the invention will become apparent upon reference to the following description and accompanying drawings.

DETAILED DESCRIPTION OF THE DRAWINGS

Figure 1:
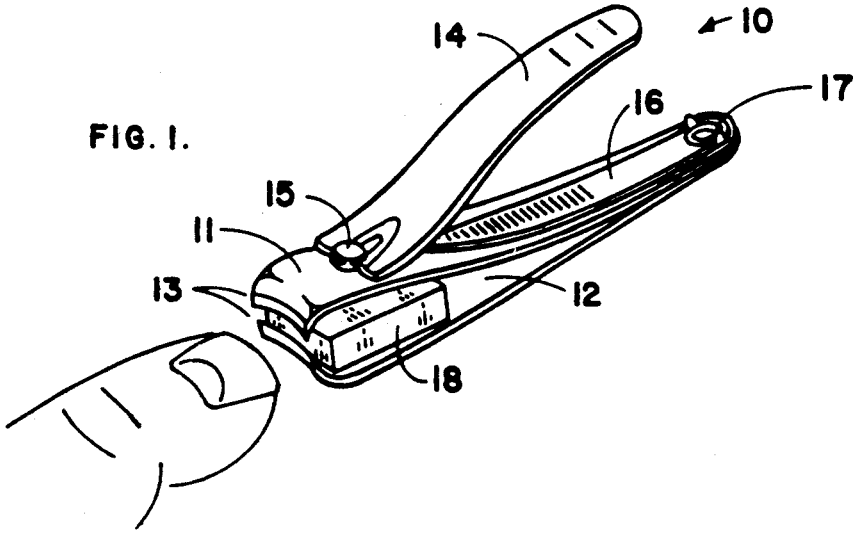
FIG. 1 is a perspective of a conventional nail clippers with the nail retainer attached thereto.
Figure 13:
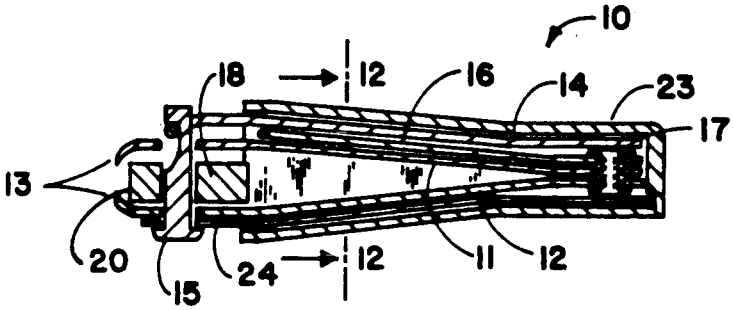
FIG. 13 is a section taken on line 13—13 of FIG. 11.

Referring to FIG. 1, the invention is shown in connection with a pocket-type nail clipper 10, having upper and lower spring arms 11 and 12. Each spring arm is secured together at one end by a spot weld or is otherwise rigidly fastened. Opposite the secured ends are cutting edges 13 which normally oppose each other due to the biasing action of the spring arms upon which the cutting edges are formed. A pin 15 and a cam lever 14 are used to actuate the spring arms 11 and 12 in a converging fashion wherein the cutting edges 13 converge and sever finger or toe nails. Rivet 17 secures nail file 16 to spring arms 11 and 12 in such a manner as to allow the nail file 16 to be rotated about the point of attachment. Cam lever 14 can pivot about pin 15 so as to be repositioned from a lever position to a compact storage position as shown in FIG. 13 The nail clipping retainer 18 attaches to or around the pin 15 and lies between the upper and lower spring arms 11 and 12.

The nail clipping retainer 18 is made of a flexible resilient material such as plastic or a rubberlike product and is formed or shaped by an injection molding process or is stamped from sheet stock. Although the drawings illustrate the nail clipping retainer 18 as being generally rectangular and flat, the critical features which must be adhered to are that the side of the retainer 18 must be located approximately 1/16 of an inch from the cutting edges 13; the thickness must be equal to the distance between the spring arms 11 and 12 when fully engaged in a cutting process; the hole throughwhich the pin 15 extends must be slightly larger than the pin; and the side nearest the cutting edges 13 must be sufficiently thick and must contact the backside of the cutting edges 13 during a non-use condition so the retainer 18 will not fit between the separation from one cutting edge to the other and will therefore retain its proper position with respect to the cutting edges 13.

Figure 2:
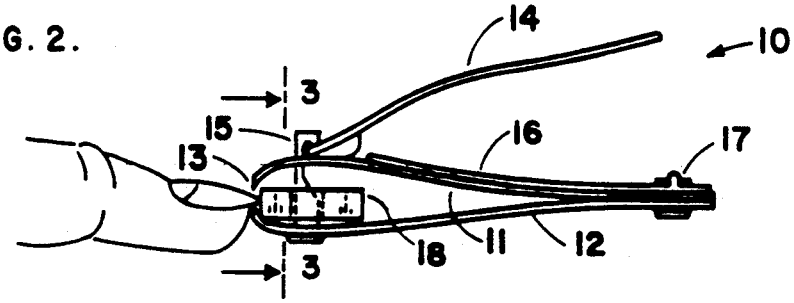
FIG. 2 is a side elevation view of the structure of FIG. 1 featuring a nail inserted prior to being cut.
Figure 3:
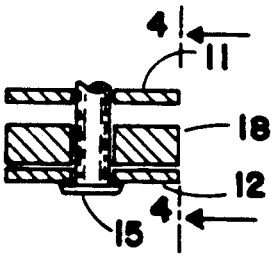
FIG. 3 is a section taken on line 3—3 of FIG. 2.

FIG. 2 illustrates the nail clipping retainer 18 in conjunction with a conventional nail clippers 10 prior to the actual cutting process. From this elevation it can be seen that the retainer 18 acts as a nail insertion depth gauge and prevents excessive nail removal.

Figure 4:
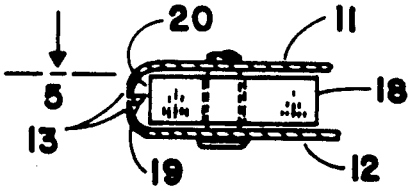
FIG. 4 is a partial side elevation view taken on line 4—4 of FIG. 3 of the structure of FIG. 2 which features a nail fragment being retained by the retainer device.
Figure 5:
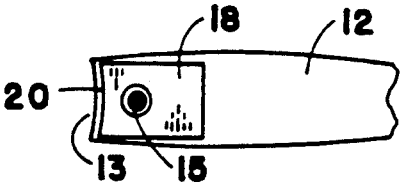
FIG. 5 is a section taken on line 5 of FIG. 4.
Figure 6:
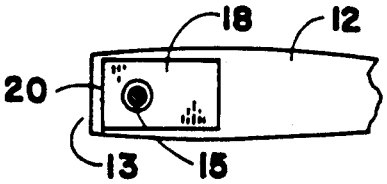
FIG. 6 is a section taken on line 5 of FIG. 4 but features straight cutting edges as opposed to those in FIG. 5.

After a nail has been cut the nail fragment 19 is contained in a void between the cutting edges 13 and the retainer 18 as illustrated in FIG. 4. To remove the nail fragment 19 the clipper operator must release the cam lever 14 to disengage the cutting edges 13 and must turn the nail clipper 10 to a vertical position whereupon a slight tap may be necessary to dislodge the fragment which will drop parallel to the cutting edges 13 and will fall into the palm of the hand of the operator.

Figure 7:
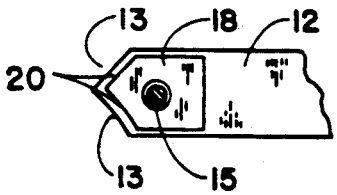
FIG. 7 is a section taken on line 5 of FIG. 4 which features straight and arcuately curved cutting edges.
Figure 8:
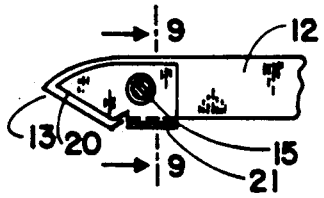
FIG. 8 is a section taken on line 5 of FIG. 4 where the cutting edges are characteristic of those found on a pliars-type of nail clippers.
Figure 9:
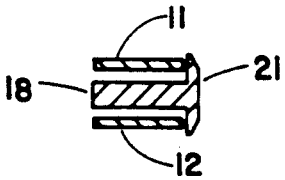
FIG. 9 is a section taken on line 9—9 of FIG. 8.
Figure 10:
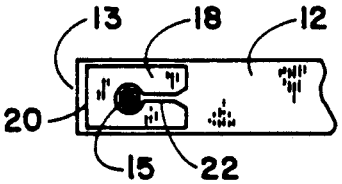
FIG. 10 is a section taken on line 5 of FIG. 4 which features a retainer with a slot for attachment to existing nail clippers.

The nail clipping retainers 18 shown in FIG. 5 through 10 illustrate various modifications which can be employed to adapt the retainer to retain nail fragments in most clipping-type nail clippers. A vertical piece 21 on the retainer 18 in FIG. 9 is employed to keep the retainer 18 in proper position when installed on a nail clipper with an angular cutting edge 13 as shown in FIG. 8. The nail clipping retainer 18 shown in FIG. 10 employs a slot 22 which allows simple installation of the retainer 18 on previously manufactured nail clipper 10. A straight and an arcuate cutting edges 13 as shown in FIG. 7 can be employed to cut either finger and/or toe nails with just one nail clipper 10.

Figure 11:
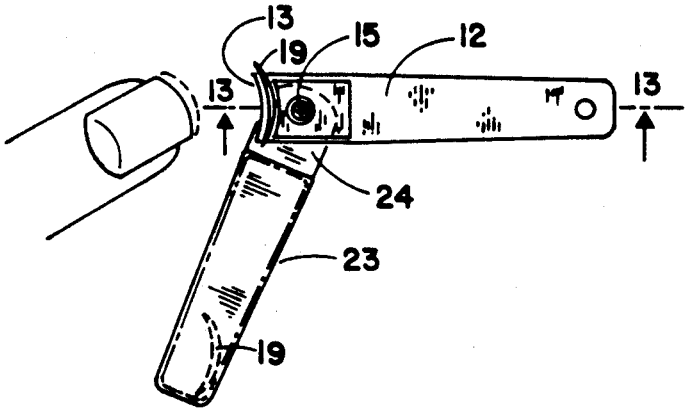
FIG. 11 is a section taken on line 5 of FIG. 4 which features the optional nail clipping keeper.
Figure 12:
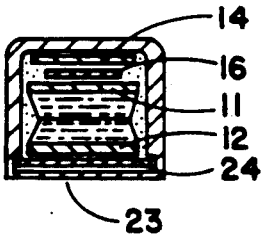
FIG. 12 is a section taken on line 12—12 of FIG. 13.

An optional nail fragment 19 keeper is shown in FIG. 11 through 13 wherein the keeper 23 encases the nail clipper 10 when not in use and can be repositioned adjacent the cutting edges 13 to receive the nail fragments 19 after the fragments are dislodged from the retainer. The nail fragment keeper 23 is a somewhat tube shaped member conforming to the perimeter of a compact pocket-type nail clippers when in a folded non-use condition and is provided with a slot-like area to receive a spring steel member 24 used as a pivotal attachment means when affixed to pin 15. To engage the nail fragment keeper 23 the user would remove it from the nail clipper 10 by pulling the keeper 23 in a direction opposite the cutting end of the nail clipper until it is free of the nail clippers and thereafter would pivot the spring steel member 24 to a position approximately parallel to the cutting edges 13 whereupon the nail keeper 23 would be repositioned upon the spring steel member 24 in a position to collect dislodged nail fragments. The spring steel member 24 is generally the shape of the spring arm 12 except that it would be thinner, slightly wider, and have a radiused end instead of a cutting edge 13. The tube-shaped nail fragment keeper 23 would be injection-molded to produce its shape and the material used in the process should form a durable and rigid product which would retain its shape when subjected to the environment encountered by pocket-type nail clippers. Aligned indentations and ridges of appropriate shapes can be used on the nail keeper 23 and the spring steel member 24 respectively so the keeper will snap into place when slid onto the spring steel member 24 and will therefore not disengage by accident. To empty the nail keeper the user must slide the keeper 23 from the spring steel member 24 and then turn the keeper so the open end faces down above a refuse container and with a tap upon the keeper the nail fragments 19 will drop into the refuse container.

It is obvious from the aforegoing description that the retainer herein described is of simple form and function and therefore would be easy to manufacture and adapt to most all fingernail or toenail clippers or a combination thereof. The retainer prevents nail fragments from scattering by providing a barrier which entraps the nail fragments as each fragment is cut. This barrier also acts as a nail insertion depth gauge to prevent removing excessive amounts of the nail. Since the retainer does not employ walls to enclose the open sides of the nail clippers it will not interfere with nails which extend beyond ends of the cutting edges. When a single nail is to be cut the user does not have to remove the retainer from the nail clippers to extract a single nail fragment. Being that the retainer is wholely contained within the nail clippers it does not interfere with a nail file attachment. Finally, the optional nail fragment keeper can be used to store a plurality of nail fragments when a disposal receptacle is not at hand.

What has been described is intended to be used by those skilled in the art to produce an apparatus to be employed to obtain the the aforegoing objectives in accordance with the invention and has not been intended to limit the scope of the invention except as maybe defined by the appended claims. Various other arrangements and applications may be employed within the principles of the present invention without departing from the spirit and nature of the invention.

I claim:

1. A nail clipper nail fragment retainer for use on conventional fingernail and/or toenail clippers having cooperating cutting edges to prevent the scattering of nail fragments comprising:

a somewhat resilient material conforming to a slab-like shape where within the perimeter thereof is a hole for accepting the pin of a conventional nail clippers, a slot communicating said hole with said perimeter, wherein said slot devoid of resilient material is provided as a means to install said slab-like shape onto said pin of said nail clippers, one edge of the said slab-like shape situated parallel to and directly rearward of the cutting edges of said nail clippers and of adequate thickness to bridge the space between the upper and lower spring arms of said nail clippers defines a barrier within said nail clippers which entraps nail fragments and prevents the scattering thereof during a cutting process, said hole through said slab-like shape being slightly larger than the diameter of the said pin to allow said pin to move freely, said edge of said slab-like shape being thick enough as not to fit between the space between the upper and lower cutting edges, said edge being in contact with the rearward surfaces of the said upper and lower cutting edges as a means to retain said edge in a position parallel to said cutting edges, said pin being retaining means for said nail clipping retainer within the confines of conventional nail clipping retainer within the confines of conventional nail clippers of the type which sever fingernails and toenails with the cutting edges coupled to the spring arms which are forced together when acted upon by a pin and cam lever assembly.

2. The apparatus according to claim 1 wherein a nail fragment keeper is provided comprising:

a tube-like rigid chamber which conforms to and enchambers a folded nail clippers when not in use, said chamber being repositionable so as to catch and store nail fragments when said nail fragments discharge from said retainer, said chamber provided with a slot-like attachment means; a spring steel member conforming to the general shape of the said lower spring arm, said spring steel member provided with a hole to pivotally affix an end of said spring steel member to said pin of said nail clippers, said hole in said spring steel member being slightly larger than the diameter of said pin, said spring steel being thinner and slightly wider than said lower spring arm, said spring steel member being positioned directly below and in contact with said lower spring arm, the pivotally affixed end of said spring steel member being radiused, said spring steel member being made to fit snuggly within said slot-like attachment means of said chamber wherein said chamber being slidable onto said spring steel member, when positioned so an open end of the chamber aligns with a discharge path of said nail fragments as the fragments drop from the nail fragment retainer the nail fragments become contained within said chamber.

3. The apparatus according to claim 1 wherein the retainer is stamped from flexible resilient sheet stock.

4. The apparatus according to claim 1 wherein the edge of the retainer forming said barrier conforms to the cutting edges of a particular nail clippers, said edge of said retainer being formed to conform to the specific type and size of conventional nail clippers to which said edge of said retainer will be installed wherein a plurality of types and sizes of nail clippers to which the retainer adapts is possible.

5. The apparatus according to claim 1 wherein the edge of said retainer acts as a nail insertion depth gauge to prevent excessive removal of material from finger and/or toe nails.

* * * * *